US006591533B2

(12) United States Patent
Wygant

(10) Patent No.: US 6,591,533 B2
(45) Date of Patent: Jul. 15, 2003

(54) LOCKING HINGE

(75) Inventor: Steven John Wygant, Syracuse, IN (US)

(73) Assignee: Blackpoint Engineering, LLC, Goshen, IN (US)

( * ) Notice: Subject to any disclaimer, the term of this patent is extended or adjusted under 35 U.S.C. 154(b) by 0 days.

(21) Appl. No.: 09/930,626

(22) Filed: Aug. 15, 2001

(65) Prior Publication Data

US 2003/0051385 A1 Mar. 20, 2003

(51) Int. Cl.[7] ..... F41C 23/00

(52) U.S. Cl. ..... 42/72; 42/73; 42/75.01; 16/327; 16/387

(58) Field of Search ..... 16/239, 292, 297, 16/366, 387, 258, 386, 371, 325, 341, 327; 42/72–73, 75.01

(56) References Cited

U.S. PATENT DOCUMENTS 2,966,697 A * 1/1961 Mintz ..... 16/325
3,710,496 A * 1/1973 Packmayr et al.
3,849,834 A 11/1974 Mayer
4,109,344 A * 8/1978 Rock et al.
4,210,979 A * 7/1980 Boyd ..... 16/327
4,226,549 A 10/1980 Batt
4,718,127 A 1/1988 Rittmann
4,736,490 A 4/1988 Wesselski
4,896,446 A * 1/1990 Gregory ..... 42/72
4,925,329 A * 5/1990 Chuang
5,063,916 A 11/1991 France
5,408,726 A * 4/1995 Kent
5,412,835 A 5/1995 Vosbikian
5,479,678 A 1/1996 Reed
5,490,306 A * 2/1996 Floyd et al.
5,524,324 A * 6/1996 Kunkel ..... 16/387
6,004,283 A 12/1999 Young
6,032,397 A * 3/2000 Iannetta ..... 42/73
6,397,433 B1 * 6/2002 Chen ..... 16/327
6,434,791 B1 * 8/2002 Chung ..... 16/387

* cited by examiner

*Primary Examiner*—Michael J. Carone
*Assistant Examiner*—L. Semunegus
(74) *Attorney, Agent, or Firm*—Taylor & Aust, P.C.

(57) ABSTRACT

A locking hinge especially used in a folding shoulder rest for paintball guns. The locking hinge comprises a first hinge plate and a second hinge plate in relative rotation. The first hinge plate has a hinge joint axis, a plurality of symmetric mounting holes, and a counter bore for receiving the locking mechanism. The counter bore in the first hinge plate contains a spring and a locking cylinder. The locking cylinder has a taper on the end directed toward the second hinge plate. The second hinge plate has a relative hinge joint axis, a plurality of tapered circular cavities or notches, and a means for symmetric mounting. The locking mechanism sufficiently aligns with the tapered circular cavities or notches at plurality of predetermined positions thereby preventing rotation of the hinge plates. A minor misalignment between the locking mechanism and tapered circular cavities further provide rigid locking of the hinge plates.

14 Claims, 6 Drawing Sheets

LOCKING HINGE

FIELD OF THE INVENTION

This invention relates to locking hinges especially for use in a folding shoulder rest for paintball guns.

BACKGROUND—DESCRIPTION OF RELATED ART

Locking hinges presently exist in folding shoulder rests built for real guns. Such shoulder rests are not readily adaptable for use on paintball guns. Paintball gun shoulder rests that exist are only telescopic for arm length. Such a paintball gun shoulder rest presents a problem in that the shoulder rest does not fold, allowing for compact storage or compact use of a paintball gun.

SUMMARY

The present invention relates to a locking hinge having two rotatable plates. A first hinge plate contains a locking mechanism, which is a spring and a locking cylinder. The locking cylinder has a tapered end directed toward the second hinge plate. A second hinge plate incorporates a tapered circular cavity or notch, which receives the tapered end of the locking cylinder. There is a misalignment of the axis of the locking mechanism and the axis of the tapered circular cavity or notch thereby providing the rigid locking of the hinge plates at predetermined positions. The first and second hinge plates have a symmetrical axis by which mounting holes are located.

An advantage of the present invention is that the intentional misalignment of the locking mechanism allows for increased part tolerances. The increased of part tolerance allows more economic manufacture of the locking hinge.

A further advantage of the present invention is the symmetrical axis of mounting. This allows the reverse swing of the locking hinge. The location of the shoulder rest, and any extra components attached to the auxiliary mounting holes, are not changed.

A next advantage of the present invention is that looseness due to wear of the hinge mating surfaces throughout the hinge life may be significantly reduced by adjusting a connecting bolt that secures the two hinge plates together through the hinge axis.

Another advantage of the present invention is that the combined misalignment and the tapered edges of the locking mechanism provide continues rigid locking and no maintenance during the life of the locking hinge.

A yet another advantage of the present invention is that all locking hinge components may be manufactured using only one type of machine.

A further advantage of the present invention is that it may be used in a variety of manufacturing disciplines including, but not limited to, manufacturing, advertising, military, navy, recreational, marine, automotive, medical, and aerospace. Such disciplines may require locking doors, poles, hatches, and orthopedic devices.

DRAWING FIGURES

Figure 1:
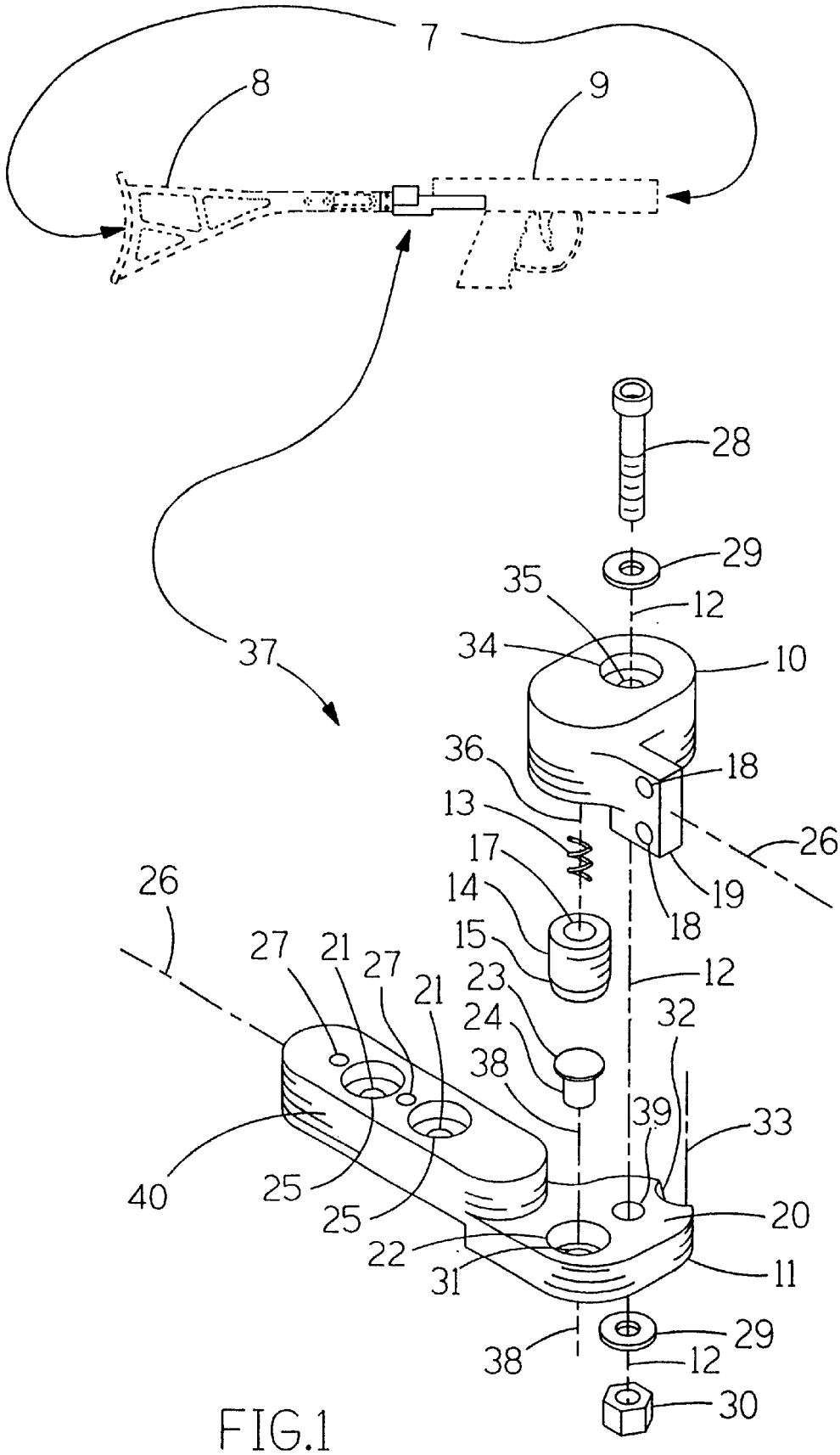
FIG. 1 is an exploded isometric view showing a locking hinge and all components.

Corresponding reference characters indicate corresponding parts throughout the figures. The exemplification's set out herein illustrate at least one preferred embodiment of the invention, in one form, and such exemplification's are not to be construed as limiting the scope of the invention in any manner.

| REFERENCE NUMBERALS IN DRAWING | |
|---|---|
| 10. | first hinge plate |
| 11. | second hinge plate |
| 12. | hinge joint axis |
| 13. | spring |
| 14. | locking cylinder |
| 15. | taper |
| 16. | receiving counter bore |
| 17. | spring guide hole |
| 18. | first hinge mounting holes |
| 19. | first hinge mounting arm |
| 20. | contact area |
| 21. | second mounting holes |
| 22. | tapered circular cavity |
| 23. | flange |
| 24. | push button |
| 25. | counter bore |
| 26. | symmetry axis |
| 27. | auxiliary mounting holes |
| 28. | hinge bolt |
| 29. | washer |
| 30. | nut |
| 31. | receiving hole |
| 32. | tapered semicircular notch |
| 33. | notch axis |
| 34. | bolt counter bore |
| 35. | first hole |
| 36. | axis of locking mechanism |
| 37. | a locking hinge |
| 38. | circular cavity axis |
| 39. | second hole |

DESCRIPTION OF THE INVENTION

Figure 2:
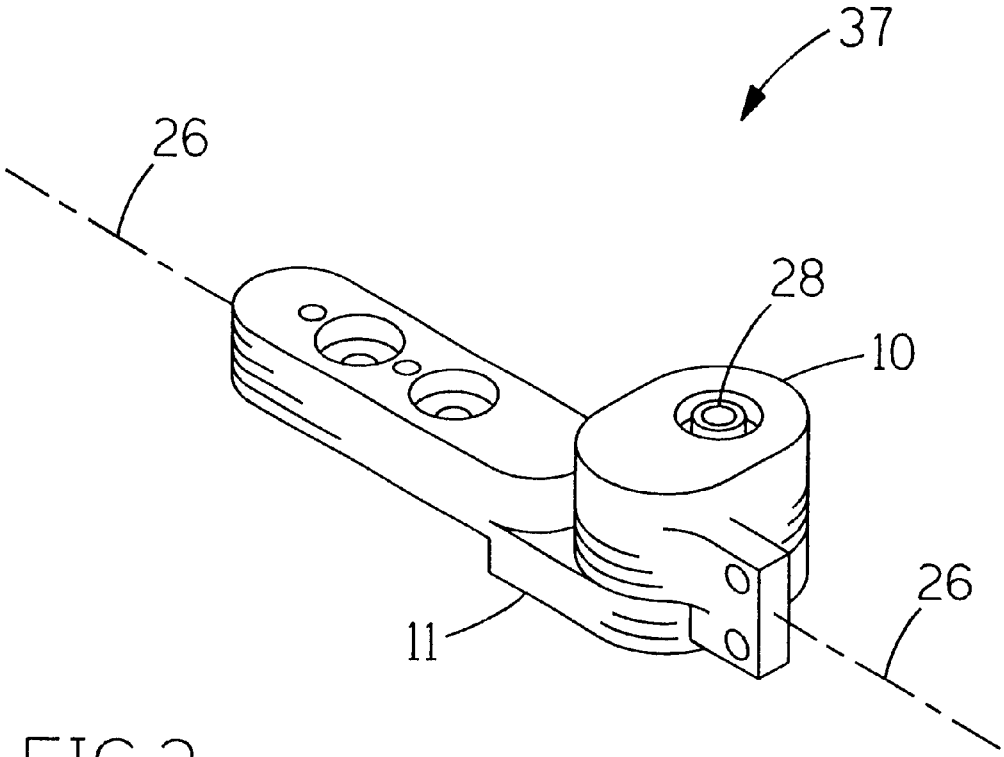
FIG. 2 is a perspective view showing a locking hinge in a open and locked position.
Figure 3:
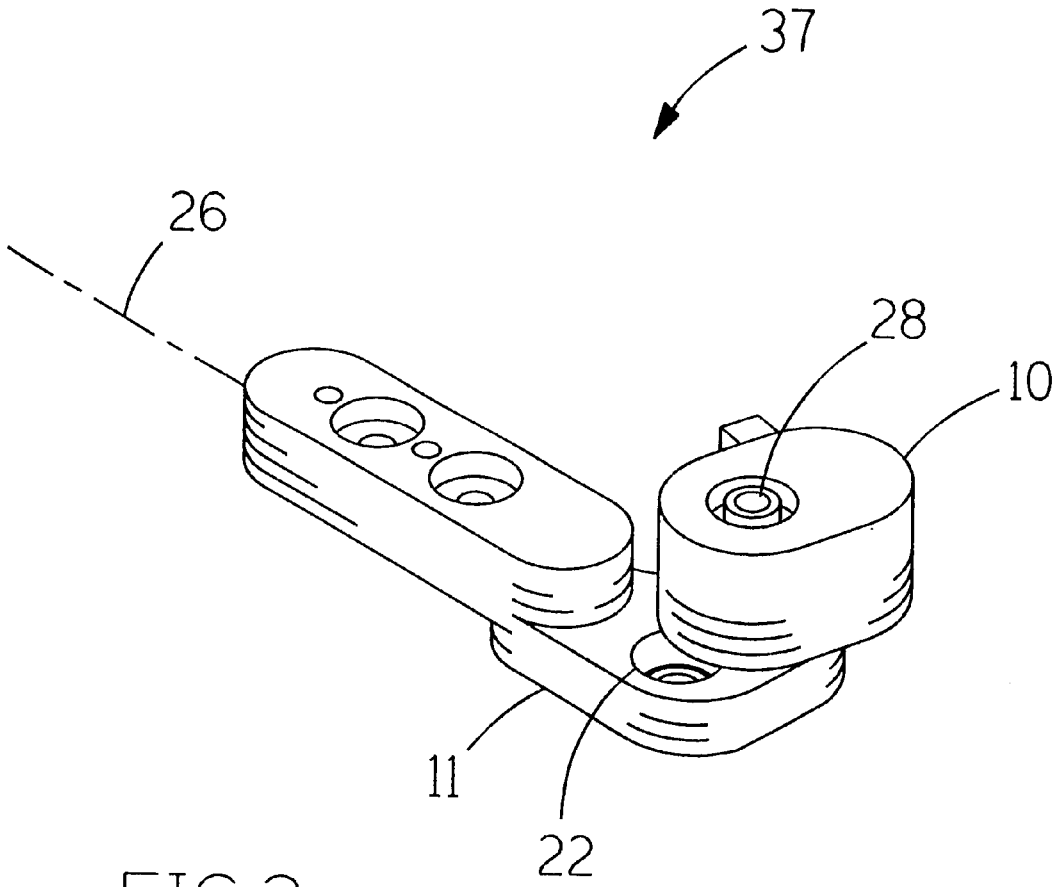
FIG. 3 is a perspective view showing a locking hinge in a closed and locked position.

Referring now to the drawings, and more particularly FIGS. 1–3, there is shown a locking hinge 37. Generally, a locking hinge 37 includes a hinge joint axis 12, a first hinge plate 10, a second hinge plate 11, a spring 13, a locking cylinder 14 and a push button 24.

The locking hinge 37 is located between shoulder rest 8 and action 9 of paintball gun 7. Shoulder rest 8 is mounted to mounting arm 19 using mounting holes 18. Action 9 is mounted to mounting arm 40 using mounting holes 21.

Figure 4:
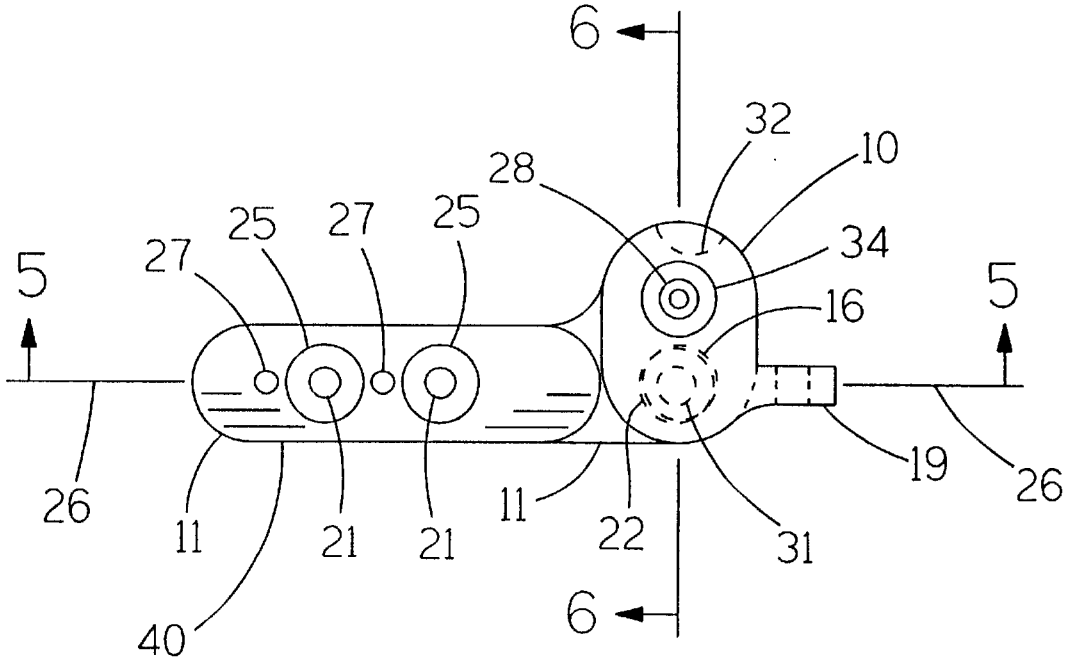
FIG. 4 is a top view showing a locking hinge in an open and locked position.
Figure 5:
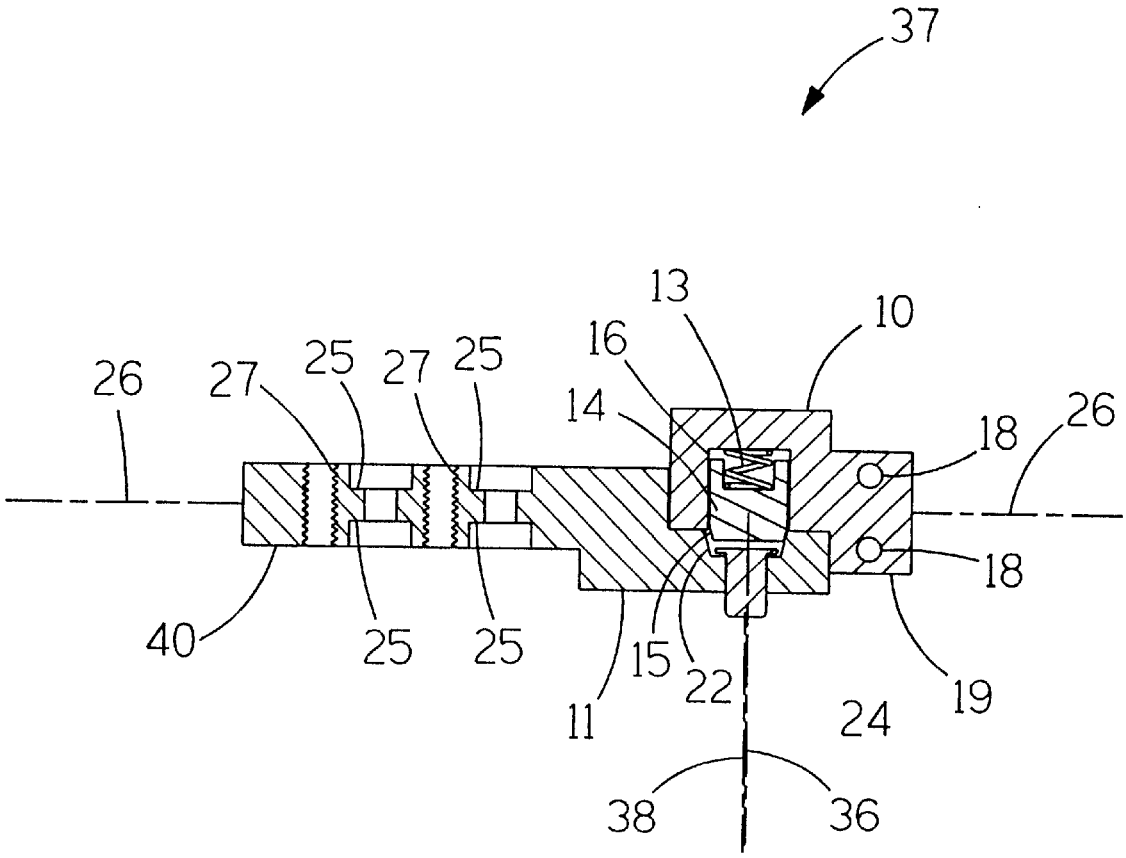
FIG. 5 is a sectional view taken along line 5—5 in FIG. 4, showing the locking hinge in an open position and the locking cylinder prior to engagement and a symmetry axis.
Figure 6:
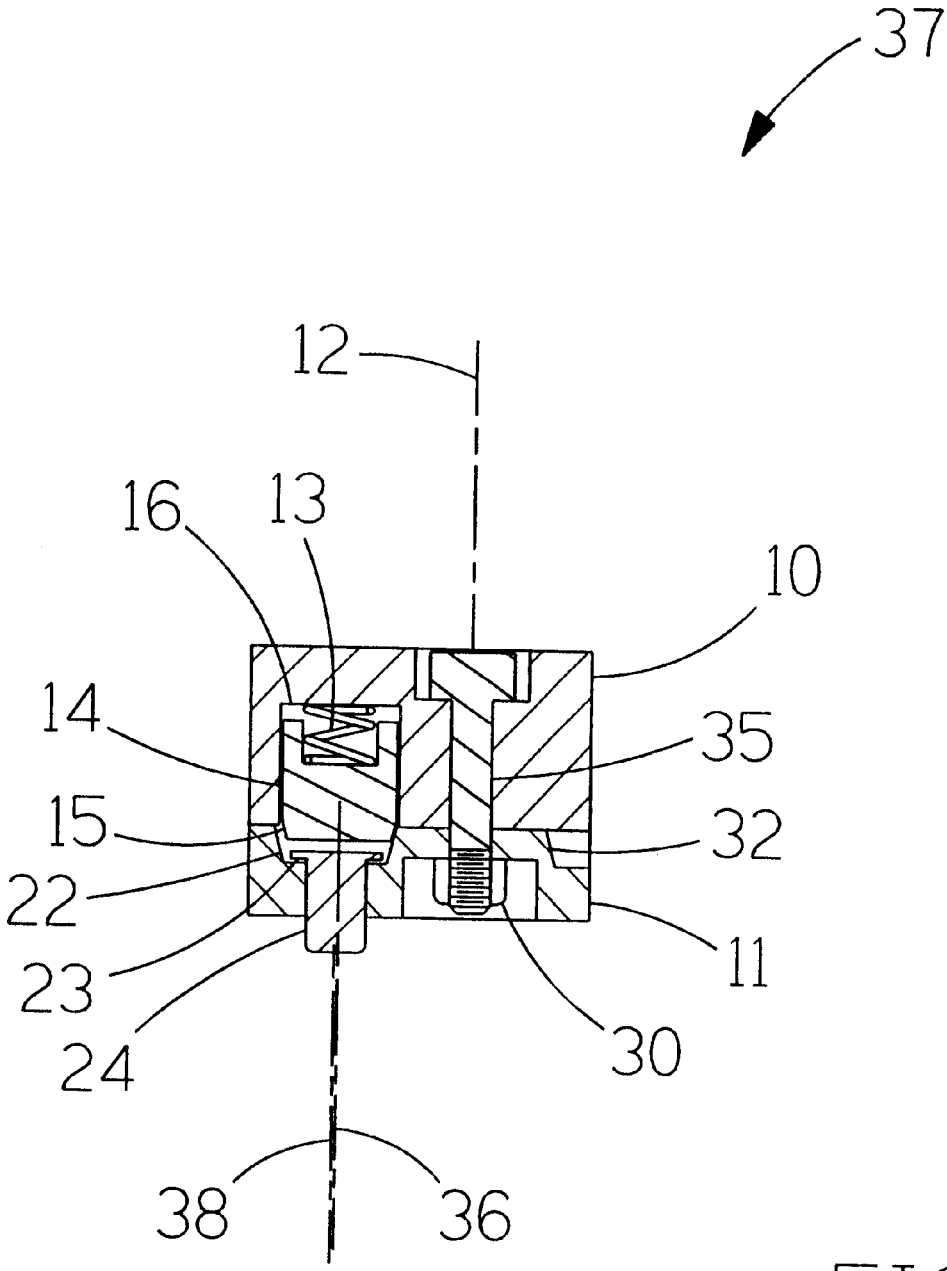
FIG. 6 is a sectional view taken along line 6—6 in FIG. 4, showing the locking hinge in an open position and the locking cylinder prior to engagement and the hinge bolt.

Shown in FIGS. 4, 5 and 6, a first hinge plate 10 has a receiving counter bore 16 which contains a spring 13 and guides locking cylinder 14. One end of spring 13 contacts the bottom of counter bore 16. The other end of spring 13 contacts locking cylinder 14 through spring guide hole 17. Counter bore 16 allows locking cylinder 14 free movement along the axis of the locking mechanism 36. First hinge plate 10 has a symmetry axis 26. First hinge mounting holes 18 are equally spaced about the symmetry axis 26.

As seen in FIGS. 1, 5 and 6, second hinge plate 11 has receiving hole 31 which push button 24 is inserted. Push button 24 stops at the bottom of tapered circular cavity 22 because of flange 23. Tapered circular cavity 22 and tapered semicircular notch 32 have similar tapered walls. Wall taper may range between 10 and 30 degrees. Push button 24 is used to disengage locking cylinder 14 from second hinge plate 11. Assemble hinge bolt 28 through washer 29 and first hole 35, and then recessed in bolt counter bore 34 in first hinge plate 10. Continuing hinge bolt 28 through second hole 39 in second hinge plate 11. Another washer 29 is placed over hinge bolt 28. The entire assembly is held together using nut 30. Nut 30 may be a nylon lock nut, which allows tightness adjustment between the first hinge plat 10 and second hinge plate 11. Contact area 20 is a considerably larger area than the cross sectional area of hinge bolt 28. The area of contact area 20 may be 20 mm squared. The cross sectional area of hinge bolt 38 may be 0.7 mm squared. Contact area 20 is relatively larger, which creates a more stable locking hinge 37.

Circular cavity axis 38 is not aligned in respect to axis of locking mechanism 36. The axis misalignment may range from 0.1 mm to 0.5 mm. The axis misalignment is a linear distance perpendicular to hinge joint axis 12. The misalignment causes taper 15 of locking cylinder 14 to wedge against tapered circular cavity 22. The wedging action tilts locking cylinder 14 against the wall of receiving counter bore 16. Taper 15 angle may range between 10 and 30 degrees. Notch axis 33 and circular cavity axis 38 are of the same radius from hinge joint axis 12.

A folded and locked position is shown in FIG. 3, where first hinge plate 10 partially covers tapered circular cavity 22. First hinge plate 10 also partially covers and retains push button 24. Locking cylinder 14 engages tapered semicircular notch 32 in this folded position. Locking hinge 37 is then unfolded by directly pressing on locking cylinder 14. Locking cylinder 14 lies inside or outside the periphery of contact area 20.

FIG. 5 shows symmetry axis 26. First hinge mounting holes 18 and first hinge mounting arm 19 are symmetric about symmetry axis 26. Second mounting holes 21, counter bore 25 and auxiliary mounting holes 27 are symmetric about symmetry axis 26. Locking hinge 37 may be mounted 180 degrees about symmetry axis 26. A reverse mounted locking hinge 37 provides use for right hand or left hand human.

In general, many components of this locking hinge would ideally be made of aluminum, plastic or other material that is inexpensive; readily formed and/or machined; and both mechanically and chemically durable. Additionally, such components may be made by any of a variety of appropriate manufacturing methods.

While this invention has been described as having a preferred design, the present inventrion can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

I claim:

1. A locking hinge used to pivot the shoulder rest from the gun action of a folding gunstock of a paintball gun, comprising:

a first hinge plate including a counterbore, a first hole, and first hinge mounting holes attachable with one of the shoulder rest and gun action; and a second hinge plate including at least one tapered circular cavity and at least one tapered notch, a second hole, and second mounting holes attachable with an other of the shoulder rest and gun action;

a hinge bolt assembled through the first hole in the first hinge plate and the second hole in the second hinge plate defining a hinge joint axis; and a locking cylinder having a tapered end and an axis parallel to the hinge joint axis, said tapered end being engageable with a selected one of said tapered circular cavities and said tapered notches, said axis of said locking cylinder and an axis of said selected tapered circular cavity or said tapered notch being laterally offset when said locking cylinder is engaged in said selected tapered circular cavity or said tapered notch.

2. The hinge of claim 1, further including a biasing device that predisposes said locking cylinder into engagement with said selected tapered circular cavity or said tapered notch.

3. The hinge of claim 2, wherein said biasing device is a compression spring.

4. The hinge of claim 1, wherein said second hinge plate has a plurality of tapered circular cavities and tapered notches at a plurality of predetermined positions.

5. The hinge of claim 1, wherein said first and said second hinge plates include a plurality of said first and said second mounting holes.

6. The hinge of claim 1, wherein said first and said second mounting holes are concentrically located about an axis of symmetry.

7. The hinge of claim 6, wherein said first and said second mounting holes are counterbored.

8. A paintball gun, comprising:

a locking hinge for pivoting a shoulder rest from a gun action, said locking hinge including:

a first hinge plate including a counterbore, a first hole, first hinge mounting holes attachable with one of the shoulder rest and gun action; and a second hinge plate including at least one tapered circular cavity and at least one tapered notch, a second hole, and second mounting holes attachable with another of the shoulder rest and gun action; and a hinge bolt assembled through the said first hole in said first hinge plate and said second hole in said second hinge plate defining a hinge joint axis; and a locking device including a cylinder and a bias device, said cylinder having a tapered end and an axis parallel to said hinge joint axis, said tapered end of said locking cylinder being engageable with a selected one of said tapered circular cavities or said tapered notches, said axis of said locking cylinder and an axis of said selected tapered circular cavity or said selected tapered notch being laterally offset when said locking cylinder is engaged in said selected tapered circular cavity or said selected tapered notch.

9. The paintball gun folding shoulder rest of claim 8, wherein said bias device includes a spring.

10. The paintball gun folding shoulder rest of claim 8, wherein an actuation device is used to selectively release said locking cylinder from engagement with said selected tapered circular cavity or said selected tapered notch.

11. The paintball gun folding shoulder rest of claim 10, wherein said actuation device is a push button.

12. The paintball gun folding shoulder rest of claim 11, wherein said push button has a cylindrical shape and includes a flange.

13. The paintball gun folding shoulder rest of claim 8, wherein said locking cylinder only partially engages into said selected tapered circular cavity or said selected tapered notch.

14. The paintball gun folding shoulder rest of claim 13, wherein said partial engagement of said locking cylinder into said selected tapered circular cavity or said selected tapered notch is disengageable by direct movement of said first hinge plate relative to said second hinge plate about said hinge joint axis.

* * * * *